US011142998B2

(12) United States Patent
Wright

(10) Patent No.: US 11,142,998 B2
(45) Date of Patent: Oct. 12, 2021

(54) SUBSEA SKID FOR CHEMICAL INJECTION AND HYDRATE REMEDIATION

(71) Applicant: David C. Wright, Spring, TX (US)

(72) Inventor: David C. Wright, Spring, TX (US)

( * ) Notice: Subject to any disclaimer, the term of this patent is extended or adjusted under 35 U.S.C. 154(b) by 154 days.

(21) Appl. No.: 16/467,468

(22) PCT Filed: Dec. 6, 2017

(86) PCT No.: PCT/US2017/064960
§ 371 (c)(1),
(2) Date: Jun. 6, 2019

(87) PCT Pub. No.: WO2018/106835
PCT Pub. Date: Jun. 14, 2018

(65) Prior Publication Data

US 2020/0072022 A1 Mar. 5, 2020

Related U.S. Application Data

(60) Provisional application No. 62/430,784, filed on Dec. 6, 2016.

(51) Int. Cl.

| | |
|---|---|
| ***E21B 37/06*** | (2006.01) |
| ***E21B 41/00*** | (2006.01) |
| ***E21B 43/36*** | (2006.01) |
| ***B63B 43/00*** | (2006.01) |

(52) U.S. Cl.
CPC ..... *E21B 37/06* (2013.01); *B63B 43/00* (2013.01); *E21B 41/0007* (2013.01); *E21B 43/36* (2013.01)

(58) Field of Classification Search
CPC ..... E21B 37/06; E21B 41/0007; E21B 43/36
See application file for complete search history.

(56) References Cited

U.S. PATENT DOCUMENTS

| | | | | |
|---|---|---|---|---|
| 6,840,088 | B2 * | 1/2005 | Tucker | F16L 1/26 73/49.5 |
| 7,210,556 | B2 | 5/2007 | Bath et al. | |
| 7,234,524 | B2 * | 6/2007 | Shaw | E21B 41/02 166/304 |
| 8,376,050 | B2 * | 2/2013 | Cumming | E21B 41/04 166/345 |
| 8,381,578 | B2 * | 2/2013 | Sweeney | B63C 11/42 73/49.1 |
| 8,413,725 | B2 | 4/2013 | Wright et al. | |
| 8,430,168 | B2 * | 4/2013 | Goodall | F16L 1/26 166/336 |

(Continued)

*Primary Examiner* — Matthew R Buck
(74) *Attorney, Agent, or Firm* — Matthews, Lawson, McCutcheon & Joseph, PLLC

(57) ABSTRACT

A skid-mounted chemical and hydrate remediation system including a subsea separator is described for use in the event of a hydrate plug with chemical injection. This system comprises a manifold which communicates between a subsea pipeline and a plurality of pumps located within a frame. This plurality of pumps comprises at least two pumps powered by ROV hydraulics which operate in series to extract fluid from the pipeline, and at least one chemical injection pump which communicates hydrate solvent through the manifold back into the pipeline. The system additionally comprises a coiled liquid/gas separator which separates the extracted fluid into liquid and gas components and returns them to the surface separately.

16 Claims, 5 Drawing Sheets

(56) References Cited

U.S. PATENT DOCUMENTS

| | | | | |
|---|---|---|---|---|
| 8,770,892 | B2 * | 7/2014 | Sweeney | F16L 1/26 405/184.1 |
| 9,435,185 | B2 * | 9/2016 | Wright | B01D 19/0042 |
| 9,441,461 | B2 * | 9/2016 | Williams | E21B 33/035 |
| 10,344,549 | B2 * | 7/2019 | Skeels | E21B 37/06 |

* cited by examiner

SUBSEA SKID FOR CHEMICAL INJECTION AND HYDRATE REMEDIATION

REFERENCE TO RELATED APPLICATIONS

The present application is a US national stage application claiming priority to Patent Cooperation Treaty (PCT) application No. PCT/US17/64960 filed 6 Dec. 2017, that in turn claims priority to and benefit of U.S. Provisional Application No. 62/430,784, filed 6 Dec. 2016, and entitled "Subsea Skin for Chemical Injection and Hydrate Remediation." The entire content of the above-referenced Patent Cooperation Treaty (PCT) Application No. PCT/US17/64960 is incorporated herein by reference.

FIELD

The present application relates, generally, to a system for CHRS (Chemical Injection and Hydrate Remediation and Separation) operations to be deployed from a skid which is located underneath a remotely operated vehicle (ROV) for subsea applications.

BACKGROUND

In petroleum production, oil and its byproducts are typically removed from wells and transported through pipelines, including subsea pipelines. The flow of oil and other fluids through a subsea pipeline can lead to the buildup of different substances within the pipe impeding fluid flow therethrough. For example, scale, paraffin and other wax, gas hydrates, ice plugs, debris, sand, and or other blockages may build up in the pipeline over time depending on the nature of the fluid flowing through the pipeline and other surrounding circumstances.

One method to prevent the formation of paraffin deposits or other blockages is to heat the pipelines. However, this method is very expensive and is not feasible for subsea pipelines submerged in the cold sea water. Other methods involve "pigging", wherein a mechanical scraping device is passed through the pipeline for scraping the inner wall, and "hot oiling," wherein heated oil is pumped through the pipeline. Both methods are cumbersome and expensive for subsea pipelines.

Another method involves chemical stimulation and depressurization of the pipeline. These methods typically involve pumps and chemical reservoirs mounted on a subsea skid system, which rests on the seafloor.

As subsea pipelines can be located in very deep water (up to 10,000 feet), these pipelines can typically be accessed through ROVs, which are also responsible for setting up the skid systems and connecting the remediation to the subsea pipeline.

A need exists for an integrated, all-in-one subsea remediation system which can be used and operated solely through ROVs.

Embodiments of the present disclosure, described herein, meet this need.

SUMMARY

The present application is directed to an inventive system and method for CHRS operations which can be deployed subsea.

Embodiments of the present invention include a system for subsea chemical injection and hydrate remediation and separation, which includes a frame mounted to a remotely operated vehicle, a liquid/gas separator that is mounted to the frame, a manifold mounted to the frame and operably connected to the first conduit, a plurality of series pumps mounted to the frame and operably connected to the manifold, wherein the plurality of series pumps convey the liquid component of the produced fluid from the liquid/gas separator, through the manifold, and subsequently to the surface via the first conduit; and a chemical injection pump mounted to the frame and operably connected to the manifold, where the chemical injection pump injects a chemical through the manifold into the subsea pipeline. The liquid/gas separator can receive produced fluid from a subsea pipeline and separate the produced fluid into a liquid component that ca be conveyed by a first conduit and a gas component that can be conveyed to the surface by a second conduit. The manifold can comprise a hydraulic connection to the remotely operated vehicle.

In an embodiment, the liquid/gas separator comprises a tubular having a plurality of coils, an inlet flange, an outlet flange, and a plurality of autoclave outlets, each outlet of the plurality of outlets located at a respective apex of each coil of the plurality of coils, wherein the gas component of the produced fluid rises through the plurality of outlets as produced fluid travels through the liquid/gas separator. In an embodiment, the plurality of autoclave outlets are operably connected to a gas outlet flange, and the gas outlet flange is connected to the second conduit. In an embodiment, the plurality of series pumps and the chemical injection pump comprise duplex pumps.

In an embodiment of the system, the frame can comprise a plurality of latches or the frame can comprise a plurality of flotation buoys.

In an embodiment, the chemical pump is supplied with a hydrate solvent through a chemical conduit, and the hydrate solvent can be supplied through the chemical conduit by means of a subsea bladder or by connection to a surface facility.

In an embodiment of the system, the plurality of series pumps can be operated through hydraulic power provided by an ROV. An emergency quick disconnect can be included between the first conduit and the plurality of series pumps, the second conduit and the liquid/gas separator, or combinations thereof.

Embodiments of the present invention also can include a method of subsea chemical injection and hydrate remediation and separation, comprising the steps of: mounting a remotely operated vehicle to a frame housing a manifold, a liquid/gas separator, a plurality of series pumps, and a chemical pump; hydraulically connecting the manifold to the remotely operated vehicle, the plurality of series pumps, and the chemical pump; positioning the remotely operated vehicle subsea such that the liquid/gas separator connects to a pipeline end termination, a pipeline, a producing well or combinations thereof, wherein the liquid/gas separator receives a produced fluid therefrom; powering the plurality of series pumps using the remotely operated vehicle to pull the produced fluid through the manifold and the liquid/gas separator, separating the liquid component into a first conduit and the gas component into a second conduit; conveying the gas component of the produced fluid to the surface via the second conduit; and conveying the liquid component of the produced fluid from the first conduit to the surface through the plurality of series pumps.

In an embodiment, the steps of the method can include injecting a hydrate solvent through the manifold to the liquid/gas separator, the plurality of series pumps, the first conduit, the second conduit, or combinations thereof. The steps of the method can further comprise injecting the hydrate solvent through the manifold into a pipeline end termination, a pipeline, a producing well, or combinations thereof. The injecting of the hydrate solvent through the manifold can comprise powering the chemical pump using the remotely operated vehicle (ROV).

For example, in an embodiment, the invention comprises a frame enclosing a manifold having at least one hydraulic conduit for fluid communication with a subsea pipeline, and a plurality of series pumps which pull a vacuum through the manifold to extract fluid from the subsea pipeline. This fluid continues through a liquid/gas separator which comprises a plurality of coils, an inlet flange, an outlet flange, and a plurality of autoclave outlets located at the apex of the coils which utilize gravity to separate the gas from the liquid as it is moved through the coils. The separated fluid is returned to the surface through the outlet flange and a first conduit, while the separated gas is returned through the autoclave outlets and a second conduit. The frame also encloses a chemical injection pump operably connected the manifold for injecting a hydrate solvent through the manifold (selectively conveying it to the component to be treated) simultaneously with the extraction; this chemical injection pump may receive hydrate solvent through a chemical conduit in communication with either a subsea bladder or a surface facility. In an embodiment, the series pumps and chemical pump comprise interchangeable duplex pumps. In an embodiment, the frame may additionally comprise a plurality of latches and/or flotation buoys for ease of mounting to an ROV. In an embodiment, the plurality of series pumps are operated by hydraulic power provided by said ROV.

In a method embodiment, an ROV is connected to a frame housing a manifold, liquid/gas separator, plurality of series pumps, and a chemical pump. The ROV is positioned adjacent to a PLET, pipeline, producing well, or combination thereof, such that the liquid/gas separator receives produced fluid therefrom. The ROV powers the plurality of series pumps (and in an embodiment, the chemical pump) which pull produced fluid through the liquid/gas separator and separate it into a liquid component conveyed to the surface through a first conduit, after going through the manifold and the plurality of series pumps, and gas component conveyed to the surface through a second conduit. Using the chemical pump, a hydrate solvent can be injected through the manifold into any component of the system, including the liquid/gas separator, plurality of series pumps, first conduit, second conduit, PLET/pipeline/producing well, or combinations thereof.

The above general descriptions and the following detailed descriptions are merely illustrative of the generic invention, and additional modes, advantages, and particulars of this invention will be readily suggested to those skilled in the art without departing from the spirit and scope of the invention.

BRIEF DESCRIPTION OF THE DRAWINGS

In the detailed description of the embodiments, presented below, reference is made to the accompanying drawings.

One or more embodiments are described below with reference to the listed Figures.

DETAILED DESCRIPTION OF THE EMBODIMENTS

Before describing selected embodiments of the present disclosure in detail, it is to be understood that the present invention is not limited to the particular embodiments described herein. The disclosure herein is illustrative of one or more presently preferred embodiments and variations thereof, and it will be appreciated by those skilled in the art that various changes may be made without departing from the spirit of the invention.

As well, it should be understood the drawings are intended to illustrate and plainly disclose presently preferred embodiments to one of skill in the art, but are not intended to be manufacturing level drawings or renditions of final products and the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings to be illustrative and non-limiting, and that the components may be oriented differently, for instance, during transportation and manufacturing as well as operation.

The present disclosure relates, generally, to a system and method for chemical and hydrate remediation of subsea pipelines.

Figure 1:
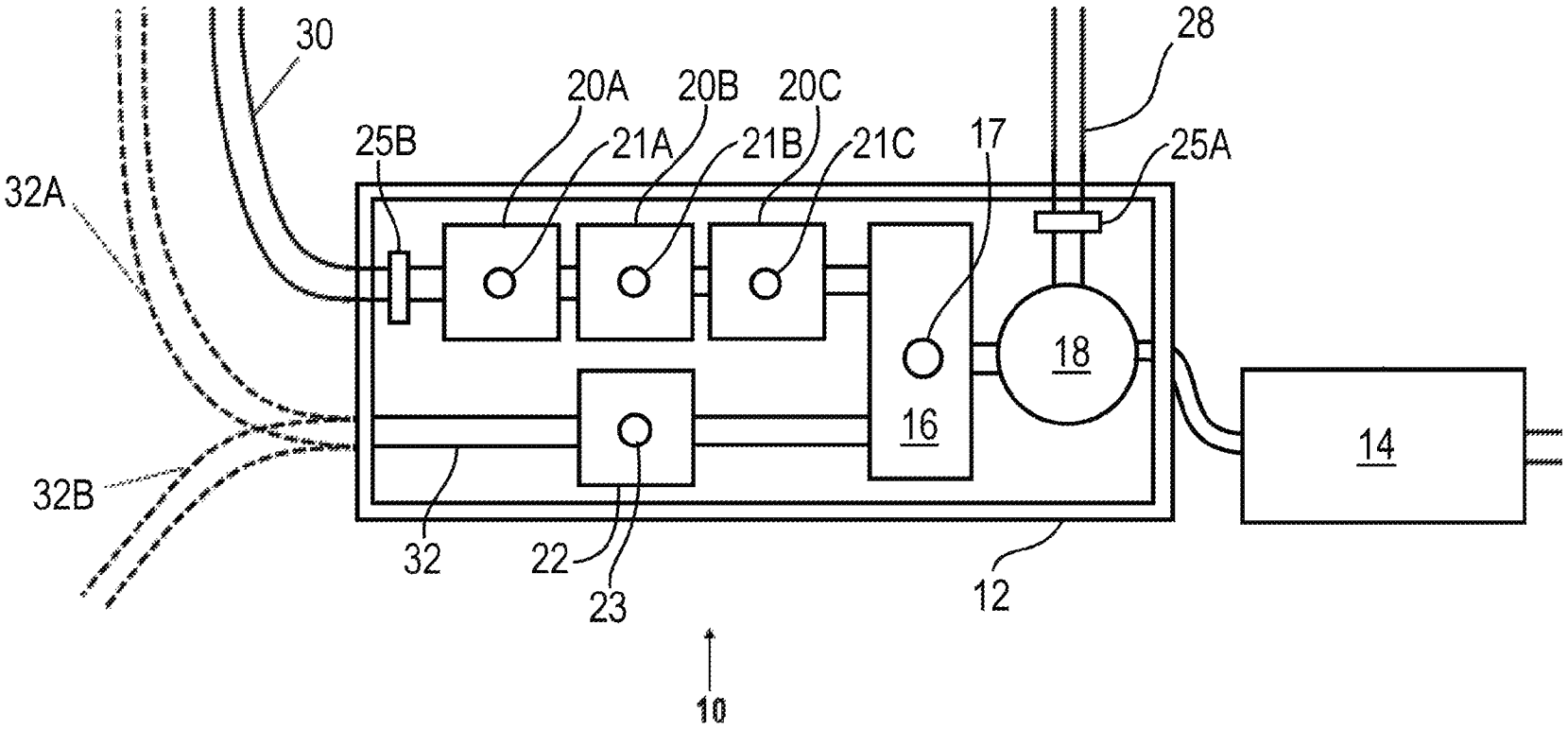
FIG. 1 depicts a schematic of an embodiment of the claimed system.

With reference to FIG. 1, the schematic shows the system 10 enclosed in a skid frame 12 that comprises a universal mounting system which can fit any work-class of ROV. The apparatus may be directly mounted to the skid or may be a remote system, which can be connected to the skid through interface lines (e.g., a "belly pack").

The system 10 is placed in fluid communication with a subsea pipeline through a Pipeline End Termination (PLET) 14, a standard form of closure known in the art. Directly connected to the PLET 14 through the frame 12 is a liquid/gas separator 18, which separates the liquid component of the produced fluid into a first conduit 30 and the gas component into a second conduit 28. Second conduit 28 proceeds upward to the sea surface where the gas can be removed or vented. In an embodiment, an emergency quick disconnect 25A can allow rapid disconnection of the system 10 from the second conduit 28.

First conduit 30 proceeds through manifold 16, which allows injection and extraction from the pipeline. Manifold 16 may comprise a plurality of ROV-operated valves (e.g., ball valves) which can be used to control the system through the hydraulic fluid supplied by the ROV through hydraulic conduit 17. Manifold 16 may further comprise a display panel to allow the ROV operator to monitor pump speed, upstream and downstream pressures, as well as chemical pressures.

As shown in FIG. 1, a plurality of pumps 20A, 20B, and 20C can be connected to the first conduit 30 in series to motivate the produced fluid, and powered by a respective plurality of hydraulic connections 21A, 21B, and 21C to the ROV, which can act as the prime mover. While three pumps are depicted in this embodiment, it can be appreciated that other embodiments may have two, four, or any number of hydraulic pumps capable of depressurizing the production pipeline. In an embodiment, multiple duplex pumps can be used which have the capability to pull a vacuum while also having the capability to inject chemicals. In another embodiment, the pumps can be high flow pumps that are capable of 30-50 gpm (gallons per minute) pump capacity. Depressurization may reach 100 psig (pounds per square inch gauge) at a depth of 10,000 ft. Conduit 30 then proceeds upward to the sea surface for fluid capture. Conduit 30 is also connected to the system 10 via an emergency quick disconnect 25B.

In addition to the depressurization, additional remediation of hydrate plugs may be effected by chemical pump 22, which can be connected to manifold 16 through chemical conduit 32, as shown. Chemical pump 22 may inject any suitable hydrate solvent (e.g., alcohol, glycol) into the pipeline through the PLET 14. Chemical pump 22 is supplied through chemical conduit 32, which may optionally rise to the surface 32A to connect to a production distribution system, or may be supplied through a seafloor bladder or other suitable supply 32B. (Both possibilities are depicted as broken lines). In an embodiment, the chemical pump 22 can be powered by the ROV through a hydraulic connection 23.

In a method of use, the series pumps 20A-20C can be activated with the use of hydraulic fluid from an ROV through hydraulic connections 21A-21C. ROV operator may monitor the pumps 20A-20C through a display panel on the manifold 16 or through a direct data connection (not shown) to the surface. Once activated, the series pumps 20A-20C act to depressurize the pipeline through the manifold 16 and PLET 14, which assists in the extraction of hydrate plugs. Chemical pump 22, which may be separately controlled or controlled by the ROV as with the series pumps, injects a suitable solvent into the pipeline through the manifold 16 and PLET 14, which further assists in the break-up of hydrate plugs. All fluid extracted from the pipeline is discharged at the surface through conduits 28 and 30.

Figure 2A:
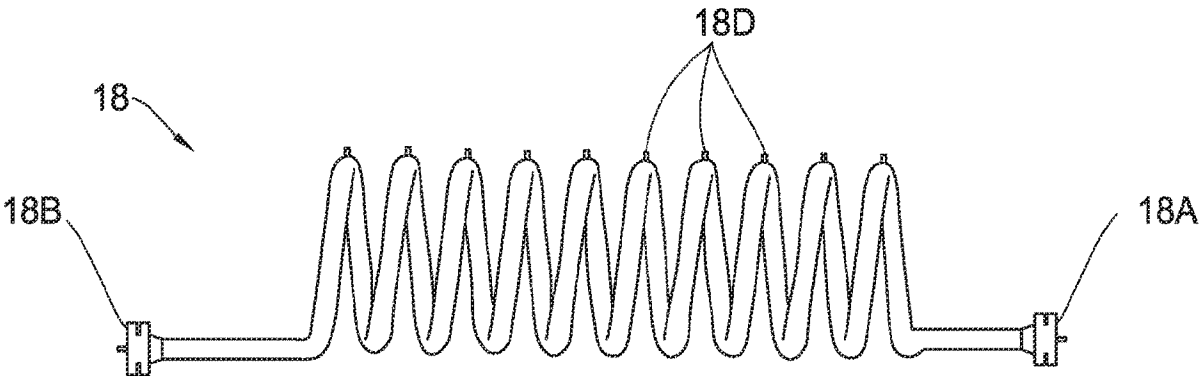
FIGS. 2A and 2B depict a side and perspective view of a gas trap embodiment for use with the claimed system.
Figure 2B:
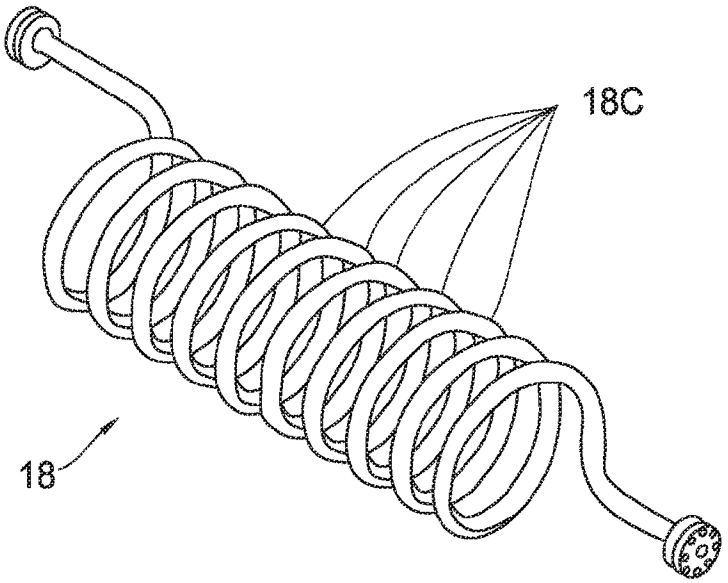

Turning now to FIGS. 2A-2B, a gas trap separator 18 is shown which may be used in an embodiment of the system 10. As shown, gas trap separator 18 can comprise two flanges, 18A and 18B, which can act as outlet and inlet ports, respectively. Between flanges 18A and 18B, a plurality of coils 18C are shown. As a pressurized fluid, both liquid and gas is pumped through said plurality of coils 18C. Due to the higher density and specific gravity, the liquid component more readily sinks to the bottom of the coils, while due to the lower density and specific gravity, the gas rises to the top. Autoclave outlets 18D, located atop the plurality of coils 18C, can provide paths for the gas to a suitable gas output conduit as depicted in FIG. 1.

Figure 3:
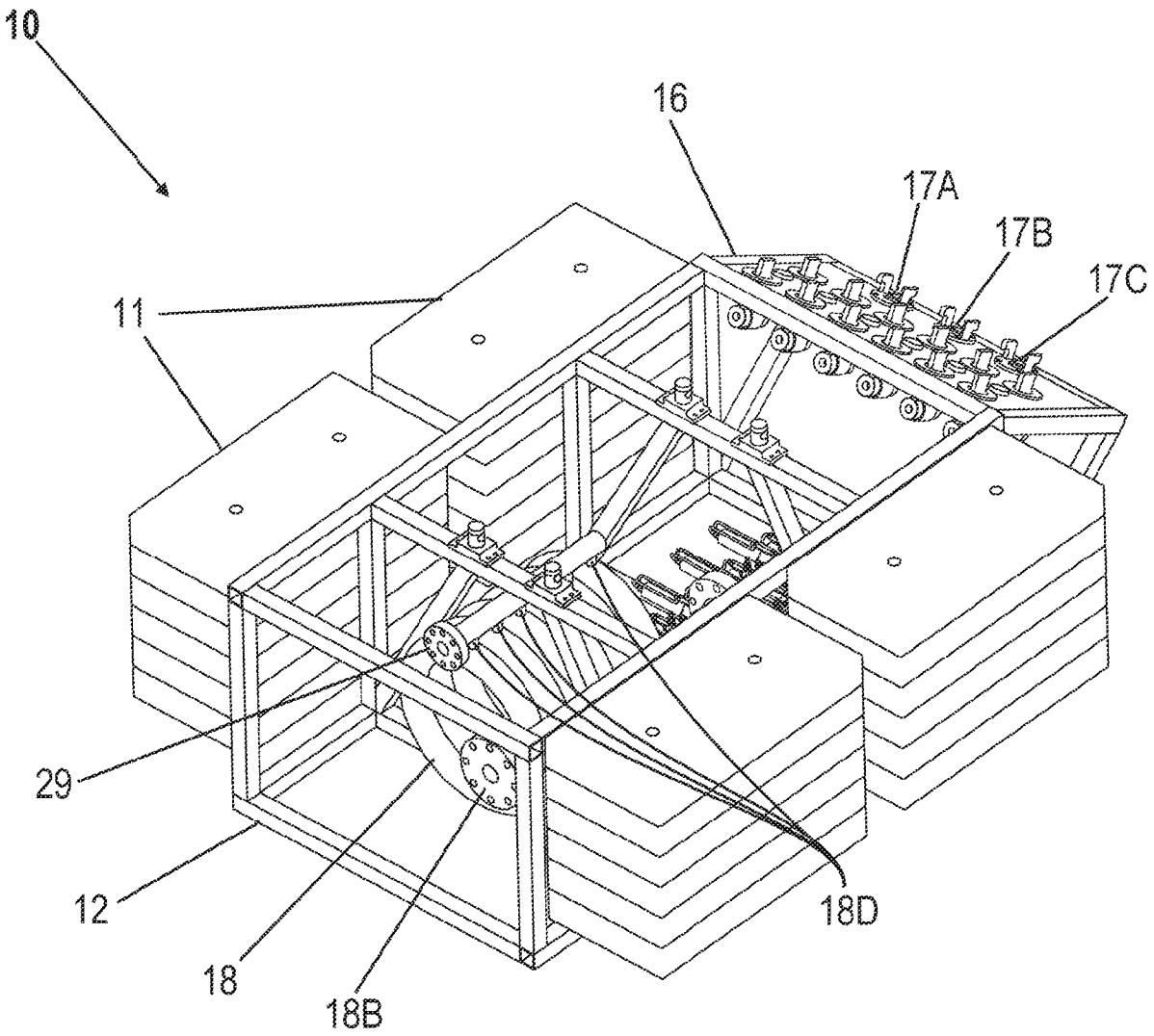
FIG. 3 depicts a perspective view of an embodiment of the claimed system.

Turning now to FIG. 3, a perspective view of an embodiment of the system 10 is shown in greater detail. In this embodiment, the conduits between the components are not shown for clarity. The system 10 is depicted with frame 12 comprising a plurality of flotation buoys 11 which counteract the weight of the system 10 and provide for easier mobility for attachment to the ROV. Gas trap separator 18, as depicted in FIGS. 2A-2B, is depicted in the frame, as well as liquid outlet flange 18B. Autoclave outlets 18D are connected to a gas output flange 29 for connection with a suitable gas output conduit 28 and emergency quick disconnect 25A (as depicted in FIG. 1).

FIG. 3 also shows an embodiment of the manifold 16 having three hydraulic conduits 17A, 17B, and 17C, which may be configured for use with a suitable ROV for establishing multiple fluid paths to and from the PLET 14 (as depicted in FIG. 1). For example, one conduit may be dedicated to extraction of produced fluid, another to the injection of chemical stimulants, and still another for hydraulic control of the entire system by the ROV.

Figure 4:
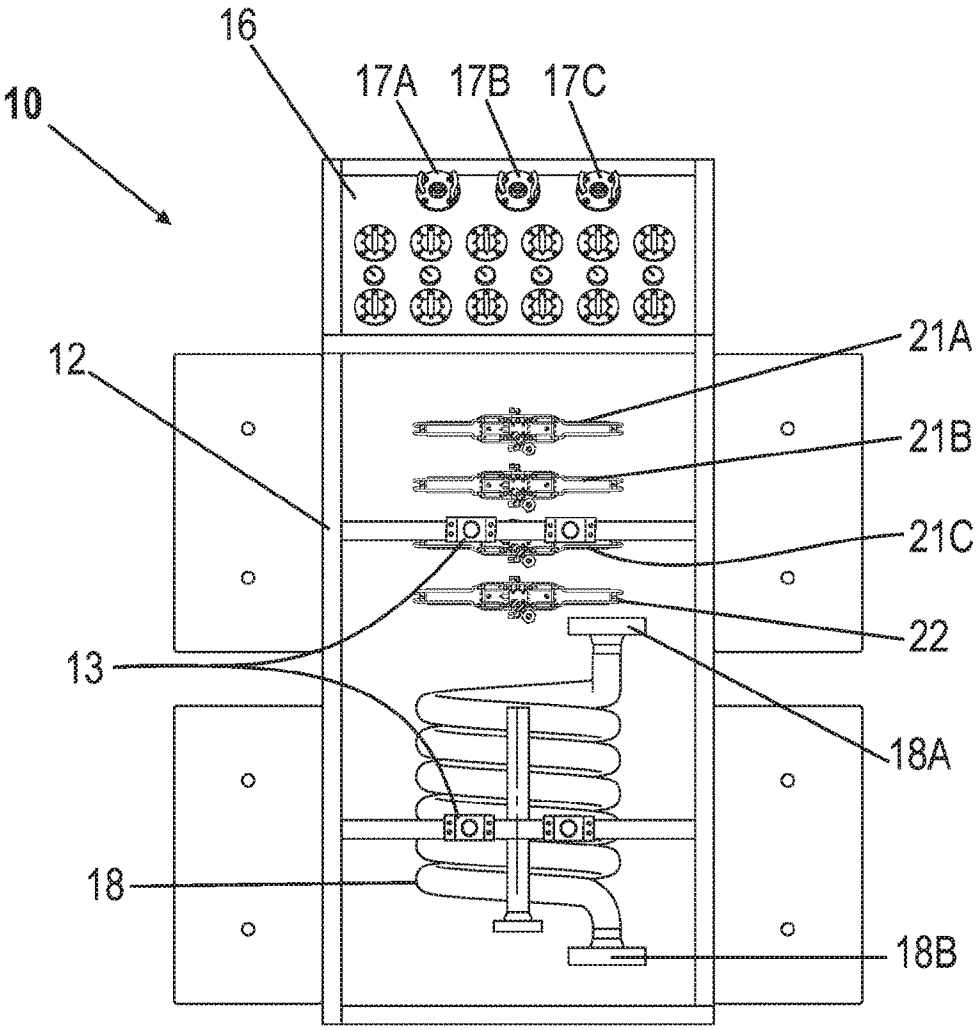
FIGS. 4 and 5A-5B depict overhead, side, and rear views, respectively, of the embodiment depicted in FIG. 3.

FIG. 4 depicts an overhead view of the embodiment of system 10 depicted in FIG. 3. This view also shows frame 12, manifold 16, hydraulic conduits 17A-C, and gas trap separator 18. Gas trap separator outlet flange 18A is also visible, on the opposite end from gas trap inlet flange 18B as depicted in FIGS. 2A-2B. This overhead view also shows series pumps 21A-C and chemical pump 22 depicted as interchangeable duplex pumps.

The conduits between the manifold, pumps, and separator are omitted for clarity in FIG. 3 and FIG. 4; it should be noted that any of series pumps 21A-C may be swapped out positionally with chemical pump 22 depending on the operation of the invention. Additional embodiments may utilize different numbers or configurations of pumps (e.g., if chemical pump 22 fails, only two pumps may be used in series to pull a vacuum, while the third can be repurposed for injection). Also depicted in FIG. 4 are latches 13 which are present at the top of the frame 12 for connection with a suitable ROV.

Figures 5A, 5B:
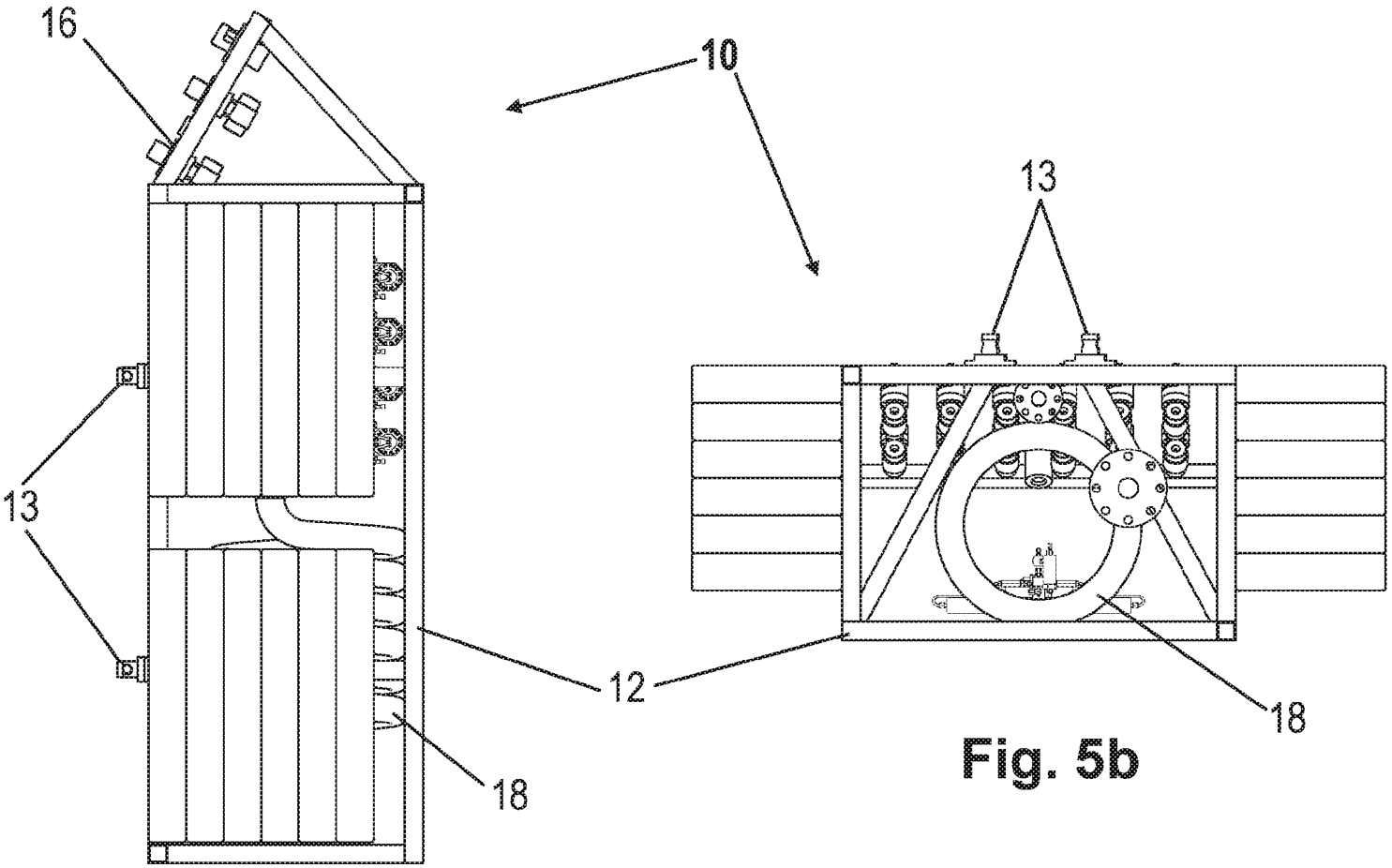

Turning now to FIGS. 5A and 5B, a side view and rear view of the system 10 is depicted, further illustrating the relationship of the latches 13 with the frame 12. Manifold 16 is positioned at the rear of the frame, and separator 18 is also depicted as shown in FIGS. 2A-2B.

While various embodiments usable within the scope of the present disclosure have been described with emphasis, it should be understood that within the scope of the appended claims, the present invention can be practiced other than as specifically described herein.

What is claimed is:

1. A system for subsea chemical injection and hydrate remediation and separation, the system comprising:

a frame mounted to a remotely operated vehicle;

a liquid/gas separator mounted to the frame, the liquid/gas separator receiving produced fluid from a subsea pipeline and separating produced fluid into a liquid component conveyed by a first conduit and a gas component conveyed to a surface by a second conduit;

a manifold mounted to the frame and operably connected to the first conduit, the manifold comprising a hydraulic connection to the remotely operated vehicle;

a plurality of series pumps mounted to the frame and operably connected to the manifold, wherein the plurality of series pumps convey the liquid component of the produced fluid from the liquid/gas separator, through the manifold, and subsequently to the surface via the first conduit; and a chemical injection pump mounted to the frame and operably connected to the manifold, where the chemical injection pump injects a chemical through the manifold into the subsea pipeline.

2. The system of claim 1, wherein the liquid/gas separator comprises a tubular having a plurality of coils, an inlet flange, an outlet flange, and a plurality of autoclave outlets, each outlet of the plurality of outlets located at a respective apex of each coil of the plurality of coils, wherein the gas component of the produced fluid rises through the plurality of outlets as produced fluid travels through the liquid/gas separator.

3. The system of claim 2, wherein the plurality of autoclave outlets are operably connected to a gas outlet flange, and wherein the gas outlet flange is connected to the second conduit.

4. The system of claim 1, wherein the plurality of series pumps and the chemical injection pump comprise duplex pumps.

5. The system of claim 1, wherein the frame comprises a plurality of latches.

6. The system of claim 1, wherein the frame comprises a plurality of flotation buoys.

7. The system of claim 1, wherein the chemical pump is supplied with a hydrate solvent through a chemical conduit.

8. The system of claim 7, wherein the hydrate solvent is supplied through the chemical conduit by means of a subsea bladder.

9. The system of claim 7, wherein the hydrate solvent is supplied through the chemical conduit by connection to a surface facility.

10. The system of claim 1, wherein the plurality of series pumps are operated through hydraulic power provided by the remotely operated vehicle.

11. The system of claim 1, further comprising an emergency quick disconnect between the first conduit and the plurality of series pumps, the second conduit and the liquid/gas separator, and combinations thereof.

12. A method of subsea chemical injection and hydrate remediation and separation, comprising the steps of:

mounting a remotely operated vehicle to a frame housing a manifold, a liquid/gas separator, a plurality of series pumps, and a chemical pump;

hydraulically connecting the remotely operated vehicle to the manifold, the plurality of series pumps, and the chemical pump;

positioning the remotely operated vehicle subsea such that the liquid/gas separator connects to a pipeline end termination, a pipeline, a producing well, or combinations thereof, wherein the liquid/gas separator receives a produced fluid therefrom;

powering the plurality of series pumps using the remotely operated vehicle to pull the produced fluid through the manifold and the liquid/gas separator, separating a liquid component into a first conduit and a gas component into a second conduit;

conveying the gas component of the produced fluid to a surface via the second conduit; and conveying the liquid component of the produced fluid from the first conduit to the surface through the plurality of series pumps.

13. The method of claim 12, further comprising the step of injecting a hydrate solvent through the manifold to the liquid/gas separator, the plurality of series pumps, the first conduit, the second conduit, or combinations thereof.

14. The method of claim 12, further comprising the step of injecting a hydrate solvent through the manifold into the pipeline end termination, the pipeline, the producing well, or combinations thereof.

15. The method of claim 13, wherein the step of injecting a hydrate solvent through the manifold comprises powering the chemical pump using the remotely operated vehicle.

16. The method of claim 14, wherein the step of injecting a hydrate solvent through the manifold comprises powering the chemical pump using the remotely operated vehicle.

* * * * *